United States Patent [19]

Spong

[11] Patent Number: 4,478,346

[45] Date of Patent: Oct. 23, 1984

[54] ICE-HOLDING AND GAME-ADAPTABLE INSERT CUP FOR DRINKING CONTAINER

[75] Inventor: Gary W. Spong, Vallejo, Calif.

[73] Assignee: Antonio Valentino Pannutti, San Jose, Calif. ; a part interest

[21] Appl. No.: 369,558

[22] Filed: Apr. 19, 1982

[51] Int. Cl.[3] ..... A47G 19/22; B65D 90/04

[52] U.S. Cl. ..... 220/90.2; 220/410; 62/400

[58] Field of Search ..... 62/400, 398; 220/254, 220/90.4, 90.2, 408, 410, 287, 403; 222/547, 570; 273/417; 141/337, 338

[56] References Cited

U.S. PATENT DOCUMENTS

| | | | |
|---|---|---|---|
| 155,213 | 9/1874 | Woolfolk | 62/400 |
| D. 170,503 | 9/1953 | Lawner et al. | D34/5 |
| 171,204 | 12/1875 | Woolfolk | 62/400 |
| 515,833 | 3/1894 | Kuersten | 62/400 |
| 590,993 | 10/1897 | Lochmann | 62/400 |
| 607,673 | 7/1898 | Armstrong et al. | 62/400 |
| 980,956 | 1/1911 | Hulbert | 62/400 |
| 987,360 | 3/1911 | Harrington | 141/337 |
| 2,357,063 | 0/1944 | Swing | 210/163 |
| 2,553,943 | 5/1951 | Rothe | 273/106 |
| 2,744,631 | 5/1956 | Toombs | 220/90.4 |
| 2,860,876 | 11/1958 | Carlton | 273/417 |
| 3,004,657 | 10/1961 | Hyman | 220/426 |
| 3,184,126 | 5/1965 | Casull | D7/9 |
| 3,272,395 | 9/1966 | Lawyer | 222/570 |
| 3,288,344 | 11/1966 | Woollen et al. | 229/7.5 |
| 3,323,706 | 6/1967 | Gereke | 229/7.5 X |
| 3,745,290 | 7/1973 | Harnden, Jr. et al. | 220/408 X |
| 3,749,402 | 7/1973 | Adickes et al. | 273/417 |
| 3,752,320 | 8/1973 | Biro | 210/469 |
| 3,820,692 | 6/1974 | Swett et al. | 222/547 |
| 4,020,532 | 5/1977 | Lichter | 24/255 R |
| 4,187,954 | 2/1980 | Striggow | 220/90.4 |
| 4,243,156 | 1/1981 | Lobbestael | 222/541 |
| 4,262,909 | 4/1981 | Becker et al. | 273/417 |
| 4,333,583 | 6/1982 | Montemarano | 220/90.4 |
| 4,340,138 | 7/1982 | Bernhardt | 220/410 X |
| 4,348,421 | 9/1982 | Sakakibara et al. | 220/408 X |

FOREIGN PATENT DOCUMENTS

| | | | |
|---|---|---|---|
| 1048210 | 12/1958 | Fed. Rep. of Germany . | |
| 1107136 | 5/1961 | Fed. Rep. of Germany . | |
| 698633 | 10/1953 | United Kingdom | 220/254 |

*Primary Examiner*—Charles E. Phillips
*Assistant Examiner*—Robert Petrik
*Attorney, Agent, or Firm*—David Pressman

[57] ABSTRACT

For holding ice (36) in a drinking container (20) out of contact with the beverage (34) but in a manner that allows the beverage to be cooled by such ice when said container is used for drinking, an insert cup (10) which is provided which self-positions in an upper portion of said drinking container, above the beverage, and has openings (18) to allow the beverage to pass through while retaining the ice. A cap (22) with a drinking spout (24) is positioned over the mouth of the drinking container to hold the ice in while allowing one to drink from the container. The insert cup can have folded sides (42, 44) for self-adjustment to a variety of sizes of drinking containers and can also have a projectile weight (56) attached to the inside of its floor (52) so that the cup can be inverted and used as a shuttlecock (FIG. 3E).

4 Claims, 14 Drawing Figures

ICE-HOLDING AND GAME-ADAPTABLE INSERT CUP FOR DRINKING CONTAINER

BACKGROUND

1. Field of Invention

This invention relates to an ice-holding insert cup for a drinking container, particulary to such a cup which holds ice away from the drink and which, in one embodiment, can also be used as a badminton shuttlecock or the like.

2. Description of Prior Art

Heretofore many devices have been provided for handling the ice in a drinking container. These devices generally comprised screens, meshes, or other types of foraminous shields which were inserted into a cardboard, plastic, or other drinking container and which were designed to hold the ice in such drinking container while it was inverted or partially inverted for the purposes of drinking. Thereby the ice was kept away from the mouth of the drinker so that the beverage could be enjoyed more fully. These devices suffered from several disadvantages. For one, they actually held the ice in or under the beverage, so that the ice tended to absorb much heat from the beverage, thereby diluting the beverage and causing the ice to melt rapidly. Also these ice holders generally bad awkward arm extensions or other relatively awkward mechanical contrivances for holding them in the drinking container at a position sufficiently below the top rim of the drinking container to enable one to drink without interference. These arm extensions or other holders were difficult to construct, awkward, fragile, difficult to store, etc.

Accordingly several objects of the present invention are to provide an ice holder for a drinking container which is use does not allow the ice to be liquified rapidly, holds the ice away from the beverage so as to reduce dilution of the beverage, is relatively easy, simple and reliable to use and store, does not have an awkward or easily-broken shape, and also after use in the drinking container, can be employed or adapted for use as the object of play, such as a shuttlecock in badminton, or the like.

Further objects and advantages of the invention will become apparent from a consideration of the ensuing description, taken in consideration with the accompanying drawings.

DRAWING FIGURES

Figure 1A:
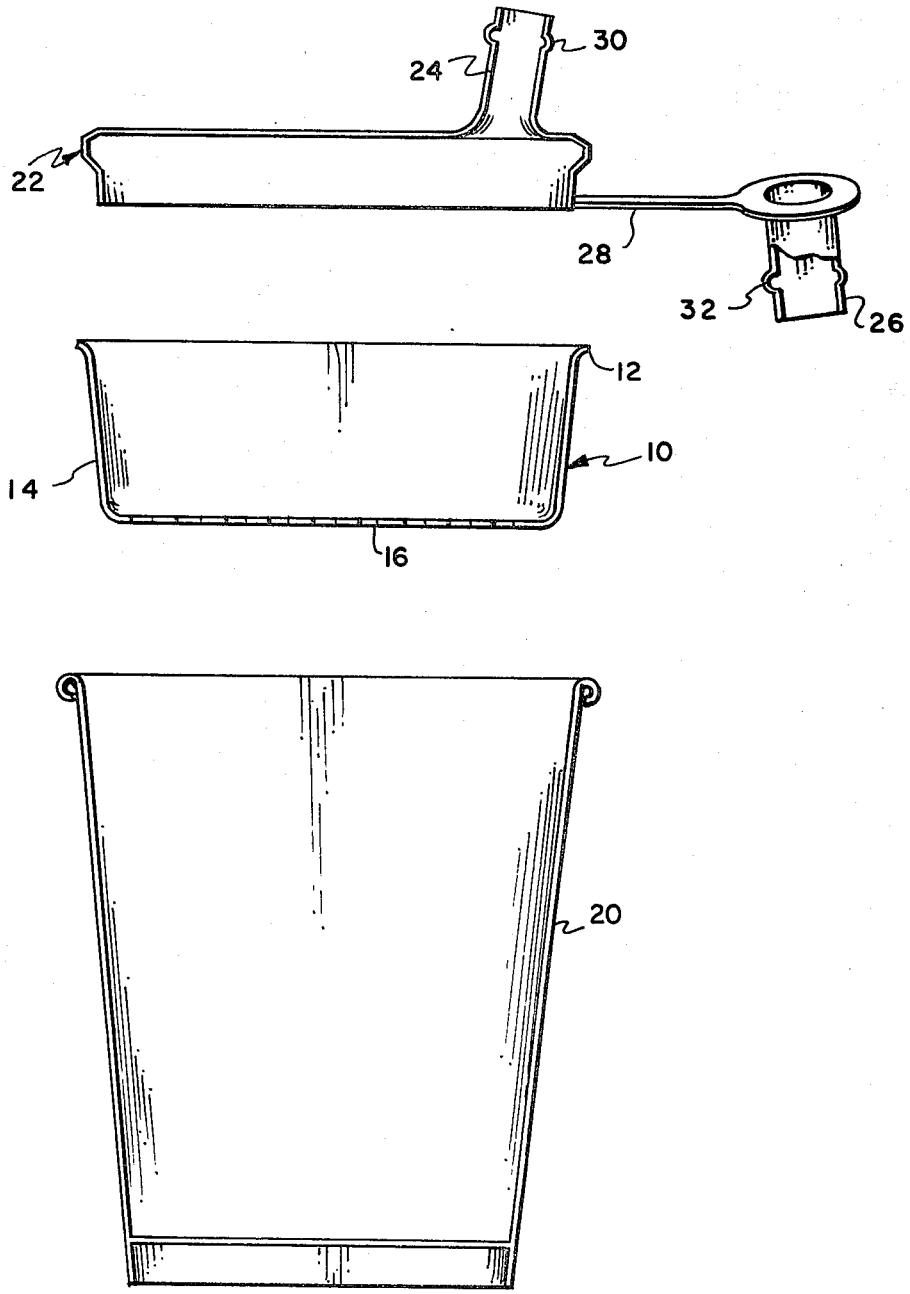
Figure 1B:
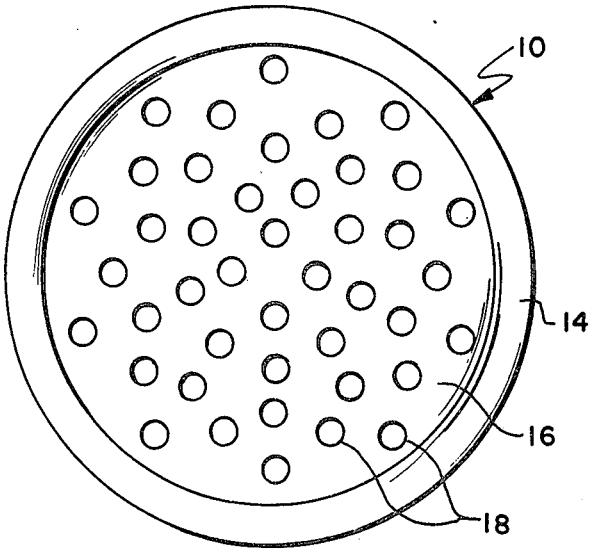
Figure 1C:
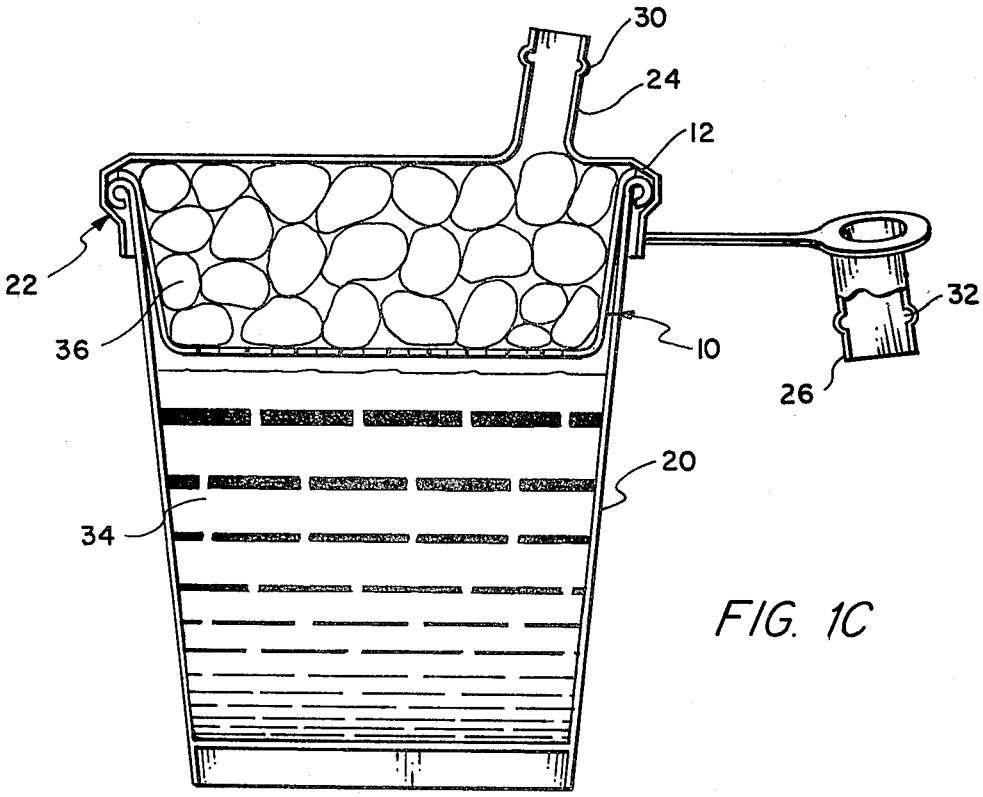
Figure 1D:
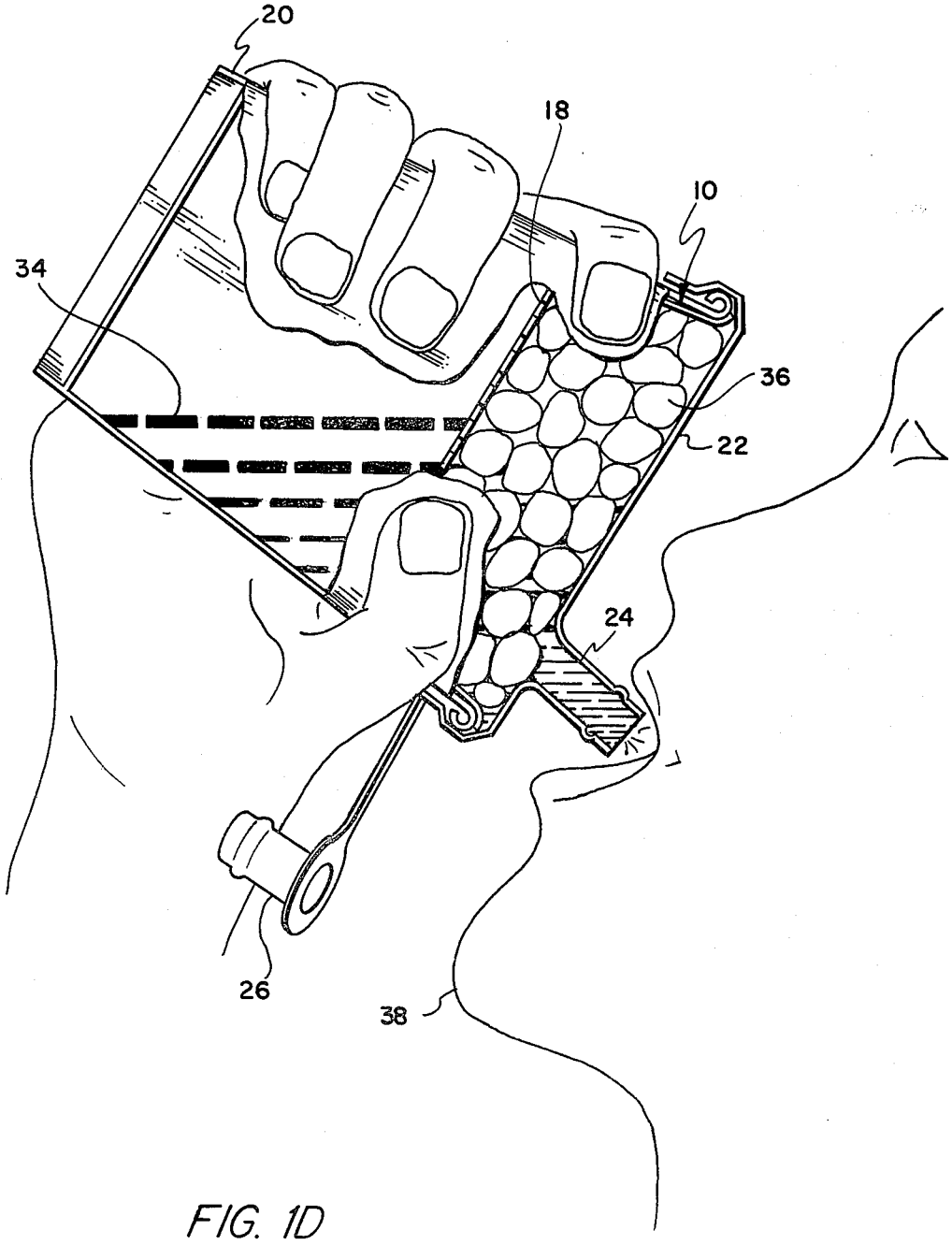

FIG. 1A shows a sectional view of a basic version of an insert cup according to the invention in exploded form; FIG. 1B shows a top view of such insert cup; FIG. 1C shows a side, cross-sectional view of such insert cup in use with its lid in a drinking container; and FIG. 1D shows a view, partially in cross section, of a person drinking from a container employing the cup and lid of the invention.

Figure 2A:
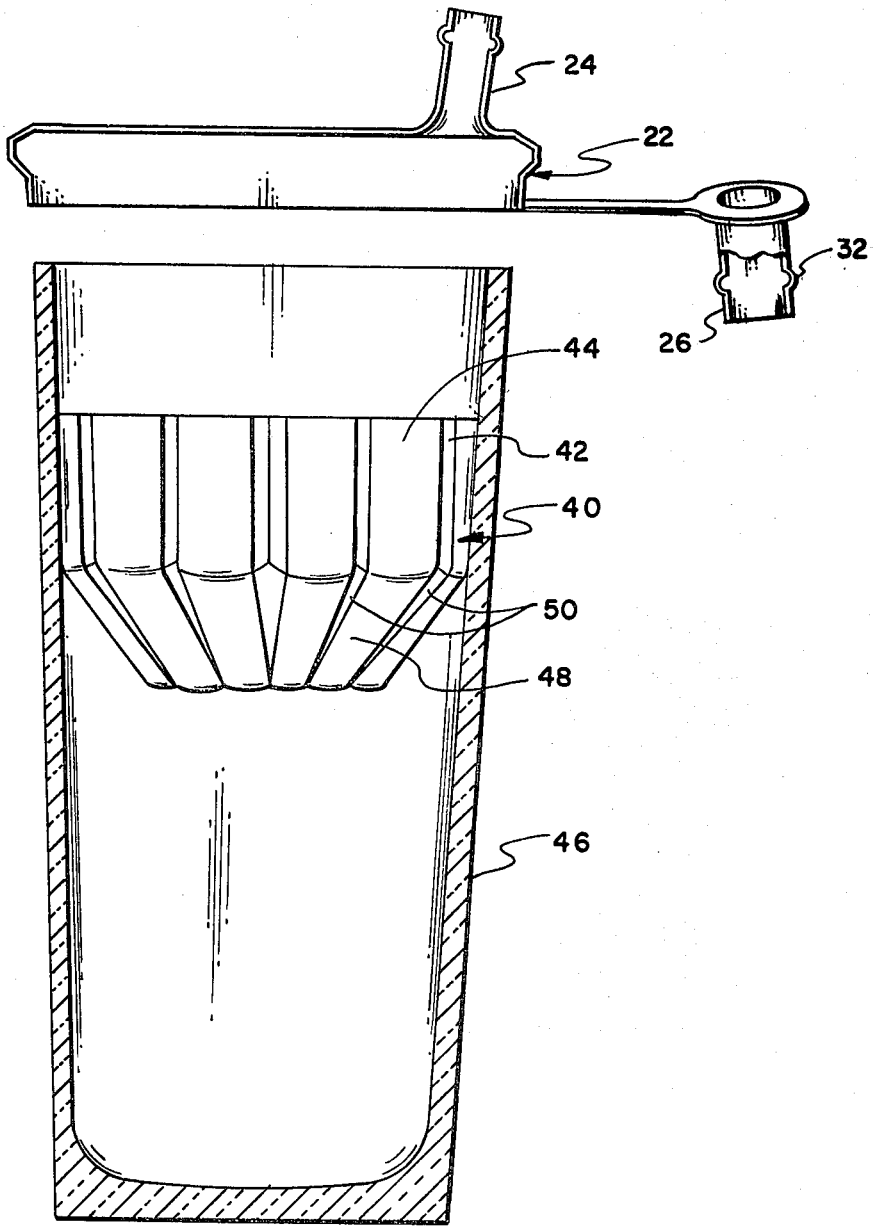
Figure 2B:
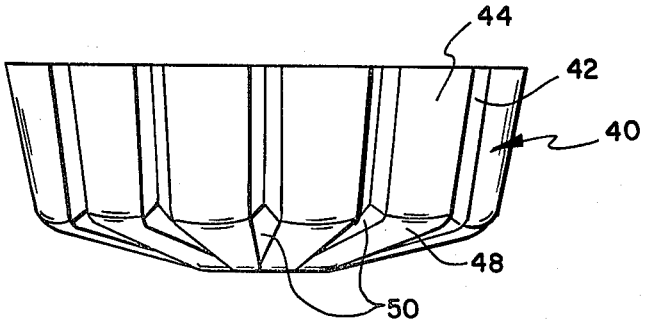
Figure 2C:
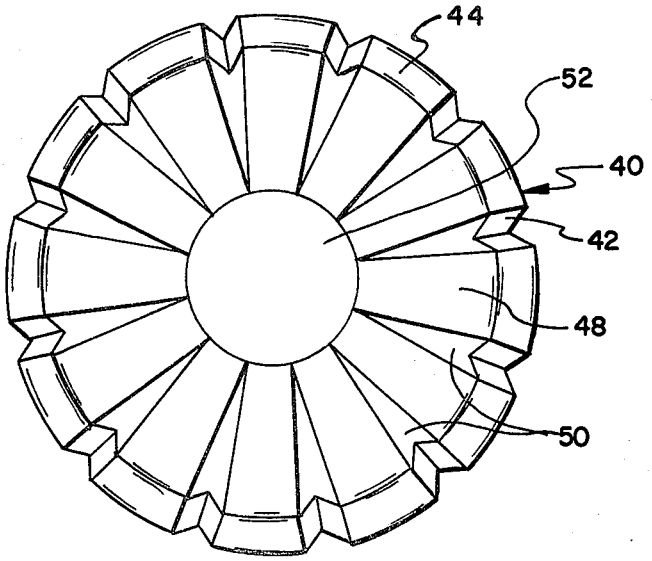
Figure 2D:
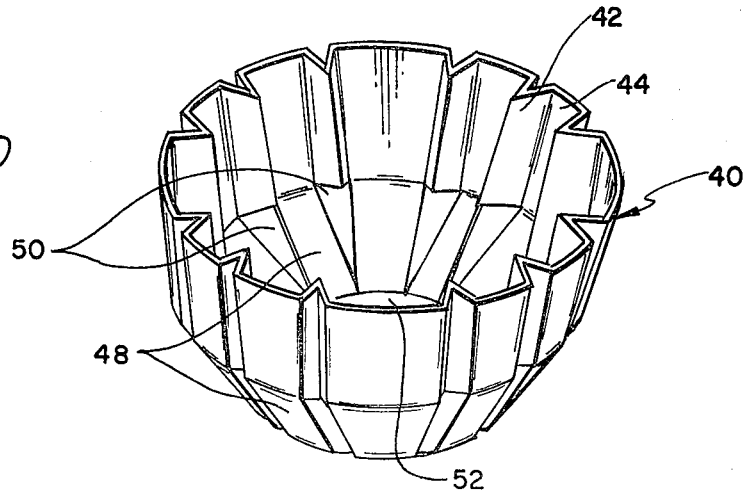

FIG. 2A shows a side sectional view of a "home" version of the insert container and lid of the invention in partially exploded form, in use within a drinking glass; FIG. 2B shows a side view of the insert cup of FIG. 2A; FIG. 2C shows a top view of such insert cup; and FIG. 2D shows a perspective view thereof.

Figure 3A:
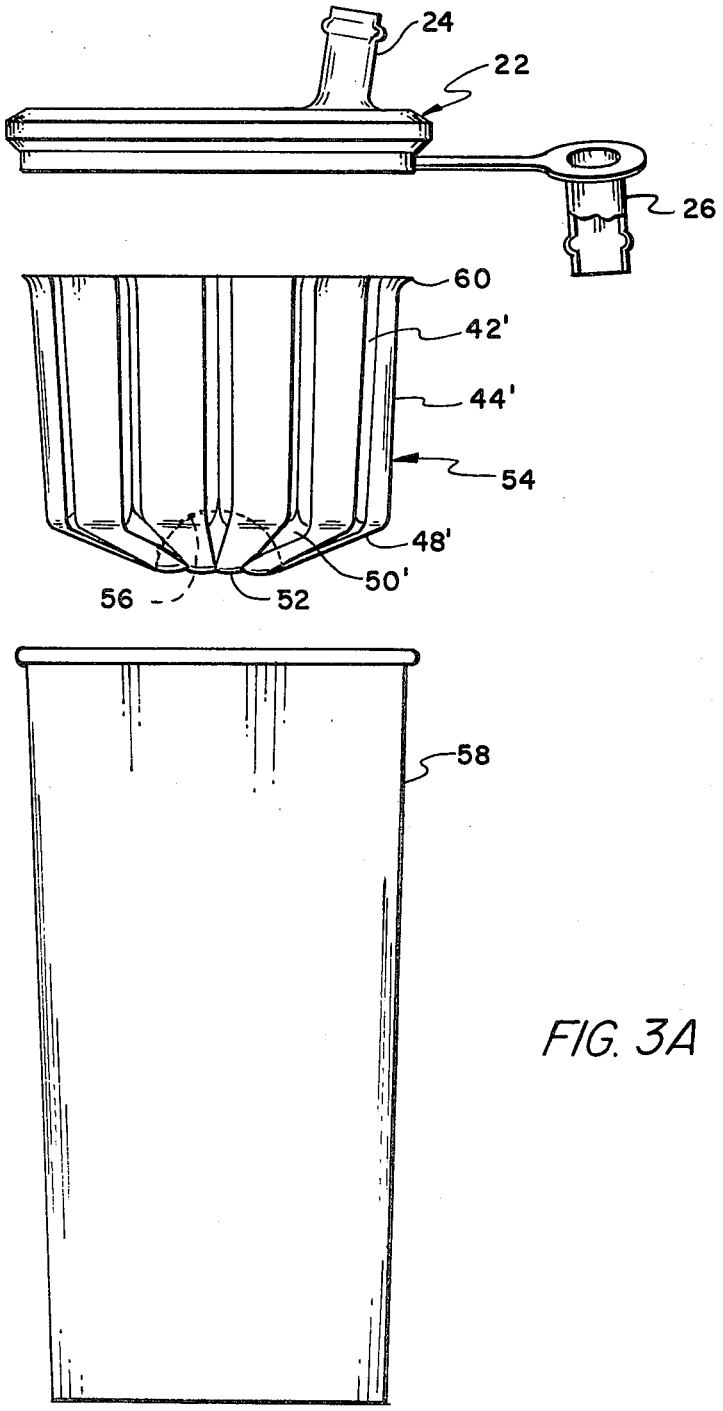
Figure 3B:
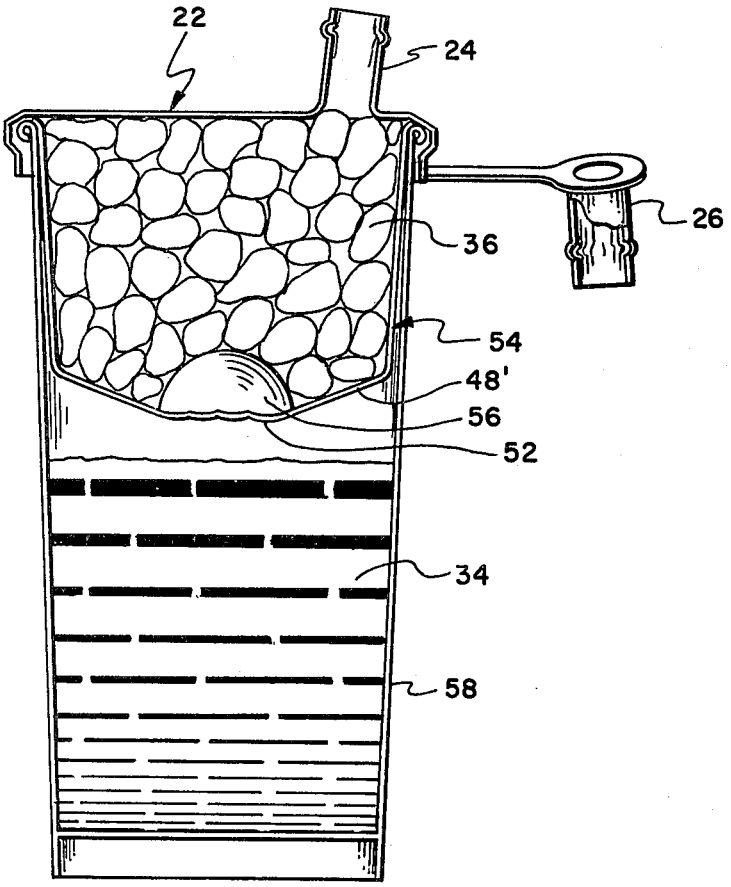
Figure 3C:
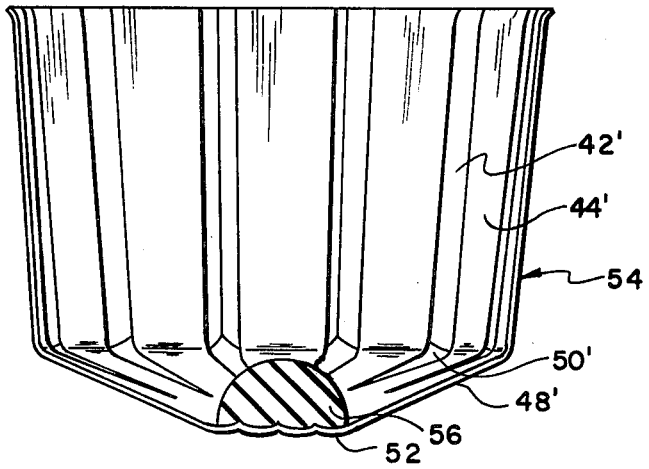
Figure 3D:
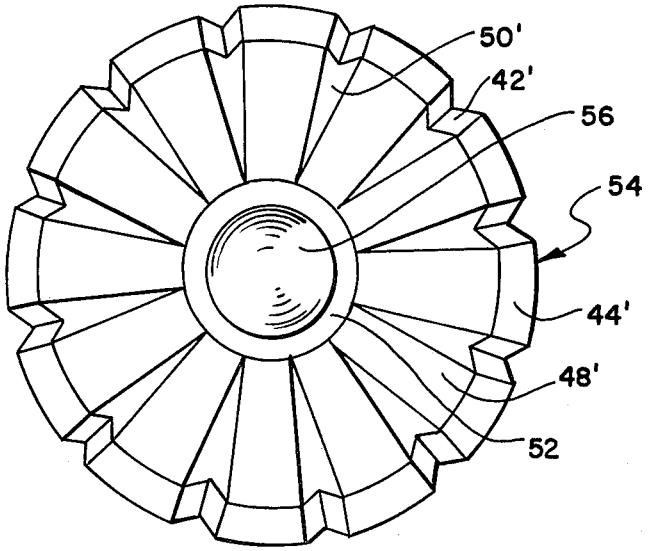

FIG. 3A shows an exploded view of a "franchise" version of an insert container and lid according to the invention in combination with a cardboard drinking cup; FIG. 3B shows a side cross sectional view of the components of FIG. 3A assembled; FIG. 3C shows a side sectional view of the insert cup of FIG. 3A; FIG. 3D shows a top view of such insert cup; and FIG. 3E shows a view of such insert cup after inversion, whereby it can be used as a shuttlecock.

Figure 4:
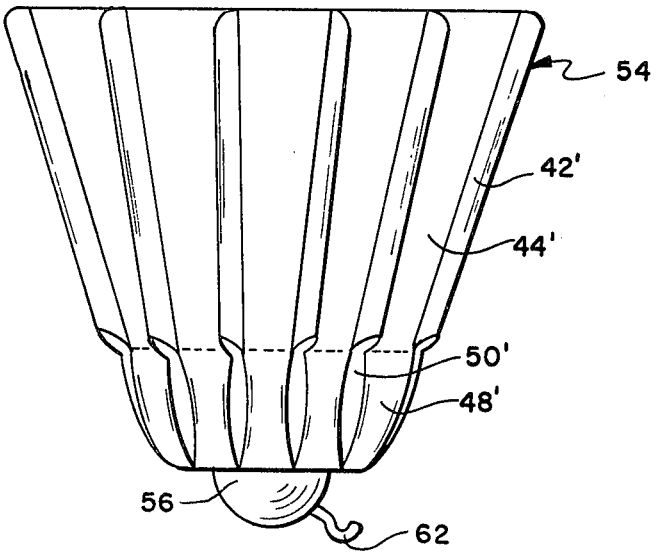
Figure 3E:
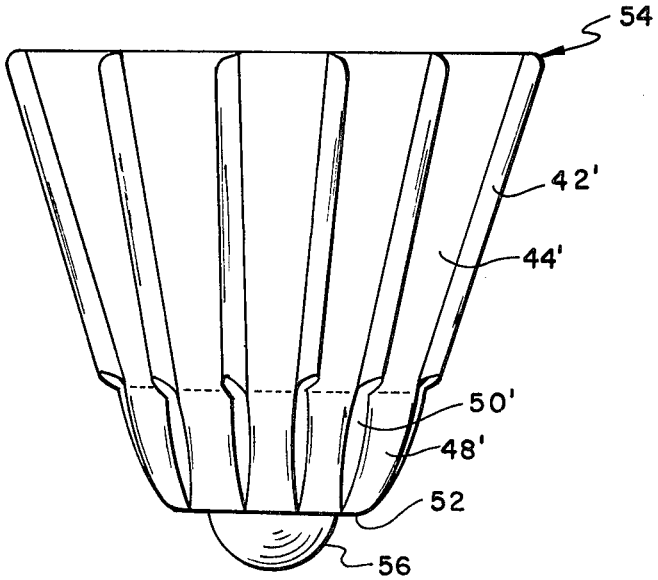

FIG. 4 shows a view similar to FIG. 3E, but wherein a launching hook is provided so that the insert cup can be used as a launched projectile.

| Drawing Reference Numerals | | |
|---|---|---|
| 10 insert cup | 12 upper rim | 14 side wall |
| 16 bottom | 18 holes | 20 container |
| 22 lid | 24 spout | 26 cap |
| 28 web | 30 ridge | 32 groove |
| 34 beverage | 36 ice | 38 drinker |
| 40 insert cup | 42 side folds | 44 side wals |
| 46 glass | 48 transitional walls | 50 slots |
| 52 floor | 54 insert cup | 56 weight |
| 58 container | 60 flared rim | 62 hook |

FIG. 1

Basic Version

The basic version of the invention, shown in FIG. 1 (parts A–D) comprises an insert cup 10 which has a slightly-flared upper rim 12, a cylindrical, generally vertical side wall 14, and a generally flat bottom 16 which has a plurality of holes, such as 18. Cup 10 is made of polyethylene or other plastic of the type used for drinking containers, or may be made of waxed cardboard, or even glass.

Cup 10 is designed to fit in a drinking container 20 of a predetermined size. For purposes of example, container 20 is shown as a waxed cardboard drinking cup, but a plastic cup or glass may also be used.

Also a lid 22 is provided in association with insert cup 10, lid 22 being designed to fit over the upper rim of container 20 as best illustrated in FIG. 1C. Lid 22 has a drinking spout 24 and a closure cap 26 which is integrally molded with the rest of cap 22 and is connected thereto by a thin web 28 such that when it is desired to seal spout 24, web 28, being flexible, will allow cap 26 to be placed over spout 24. To aid in holding cap 26 on spout 24, spout 24 has a circumferential outwardly extending ridge 30 and cap 26 has a mating circumferential groove 32.

In use, container 20 is partially filled with a beverage 34 (FIG. 1C) and insert cup 10 is placed or dropped into container 20. Due to the outwardly flaring upper rim 12 of cup 10, cup 10 will seat itself on the upper rim of container 20 as indicated. Thereafter, or prior to assembling cup 10 in container 20, cup 10 is filled with ice crystals 36 and cap 24 is assembled over the assembly 10–20. Cap 26 is then assembled to spout 24.

As indicated in FIG. 1D, when it is desired to drink beverage 34, cup 10 is inverted and spout 24 is placed within the mouth of the drinker 38, whereupon beverage 34 will flow through holes 18 in the bottom of cup 10, through ice 36 and out spout 24, into the mouth of drinker 38. In flowing past ice 36, beverage 34 will be rapidly cooled so that a chilled beverage will flow into the mouth of drinker 38.

A small air inlet hole or flap (not shown) may be provided in the portion of lid 22 remote from spout 24 if the seal between lid 22 and container 20 is too tight to admit air to replace the portion of beverage 34 which is removed by drinking.

Since ice 36 is held above beverage 34, it will last much longer and will not dilute beverage 34 as much as if it had been submerged within beverage 34. Also since only the portion of beverage 34 which is actually consumed is cooled, far less dilution of beverage 34 and far less melting of ice 36 will occur than if ice 36 had been submerged in beverage 34.

FIG. 2

Home Version

In the "home" version of the invention, shown in FIG. 2 (parts A–D), an insert cup 40 provided with side folds 42 along its substantially vertical cylindrical wall 44 such that cup 40 can assume a variety of diametrical sizes to accomodate drinking containers of a range of internal diameters. Cup 42 is shown inserted in a conventional tall drinking glass 46 and can also be used with drinking glasses or containers of slightly different diameters than glass 46. When cup 40 is in its relaxed state, as shown in FIG. 2B, it will normally assume slightly larger diameter than the range of drinking glasses or containers for which it is designed so that when it is inserted in a drinking glass or container, it will be compressed slightly so that it will hold itself in the upper portion of the drinking glass or container by friction.

Cup 40 has, extending below its side wall 44, an inwardly tapering transitional wall 48 which has open slots 50 extending below and from folds 42. Slots 50 allow the beverage (not shown) in container 46 to pass through cup 40 while retaining ice (not shown) within container 40. Container 40 also has a substantially flat, circular bottom or floor 52. The "home" version of FIG. 2 is also designed to be used with a cap 22 which is identical to cap 22 of FIG. 1.

FIG. 3

Franchise Version

In FIG. 3 (parts A–E), a version of the invention is shown which is designed to be used with drinks sold at outlets which provide take out or carry away food, such as franchised fast-food outlets. This version, in addition to providing the ice-holding function, also can be used to play badminton and other games since the insert cup can be inverted and used as a shuttlecock or launched projectile.

Insert cup 54 of FIG. 3 is generally similar to insert cup 40 of FIG. 2, except that its side walls 44' are longer, its transitional walls 48' are shorter, and its corresponding side folds 42' and slots 50' are longer and shorter, respectively. Attached to the inside surface of floor 52 is a hemispherical weight 56 of plastic, hard rubber, or the like; weight 56 may be attached to the inside surface of floor 52 by adhesive or may be integrally molded with the rest of insert cup 54.

Cup 54 is designed to be used with a tall drinking container 58 and has a flared upper rim 60 for holding itself at the upper portion of container 58. As with previous embodiments, container 54 is designed (FIG. 3D) to hold ice crystals 36 above the surface of a beverage 34 within container 58. Weight 56 takes up a very small portion of the volume of cup 54 and does not materially interfere with the ice-holding capacity of cup 54 or the flow of beverage 34 through cup 54 when container 58 is inverted.

After use, the ice in cup 54 is discarded and cup 54 is inverted so that weight 56 is on the outside, as shown in FIG. 3E. Such inversion is possible because of the diametrical expandability provided by the provision of folds 42' and slot S 50'.

When the cup is inverted, vertical wall 44' and transitional wall 48' will assume a substantially continuous straight shape, as indicated in FIG. 3E, so that the inverted cup can serve as a badminton shuttlecock. Weight 56 will be struck by the badminton racket or the like, and the rest of cup 54, weighing substantially less than weight 56, and having a flared aerodynamic shape, will serve to guide the suttlecock in flight and retard its speed, as with a conventional shuttlecock.

FIG. 4

Franchise Version with Hooked Weight

If desired, the franchise version can also be used as a launched projectile for children's games and the like by providing a hook 62 of plastic, hard rubber, metal, or the like, extending from weight 56 as indicated in FIG. 4. By the use of a rubber band, sling shot, or other launcher, the inverted cup can be launched from one location to another in games of aiming skill, catch, etc. by children and others.

While the above invention contains many specificities, these should not be construed as limitations upon the scope thereof, but as exemplifications of several preferred embodiments. Various other embodiments and ramifications are possible. For example the insert cup of the invention can have other means for holding itself at the top of a drinking container. It can have various other shapes to accomodate non-circular drinking containers. The weight in the franchise version can have other shapes. Also the holes or slots in the bottom or transitional walls of the insert cup can have other shapes or a "screen" version of the cup can be employed, i.e. the entire insert cup would be provided in mesh form. While the insert cup has been described as capable of holding ice crystals, other cooled (or heated) solid bodies, or a single cooled or heated solid body, may be employed in lieu of ice, e.g., dry ice, blue ice, etc. can be employed. Accordingly the full scope of the invention should be determined only by the appended claims and their legal equivalents.

I claim:

1. A drinking container assembly comprising;

a cup-shaped drinking container having a bottom, an integral cylindrical side wall, and an open top for holding a drinking beverage, said side wall comprising a layer of a single thickness, having an upper rim, and being thin enough at said upper rim area thereof to fit partially into the mouth of a person such that said person can easily and comfortably drink from said container;

an insert cup for said drinking container, said insert cup being cup-shaped and sized to fit in an upper portion of said drinking container, said insert cup being capable of holding a temperature-altered solid body, said insert cup having at least one opening for allowing the beverage in said container to pass through said insert when said assembly is inverted, said opening of said insert cup being large enough to allow said beverage to pass therethrough at a sufficient rate for regular human beverage drinking, said insert cup having means for holding itself at an upper portion of said container when said insert cup is placed into said container so as to hold said insert cup above the beverage in said container, said insert cup having a cylindrical side wall, the diameter of which is slightly less than the diameter of said side wall of said container so that when said insert cup is nested into said container, said side wall of said insert cup will lie adjacent said side wall of said container, said side wall of said insert cup having a plurality of folds therein which permit said insert cup to be inverted, the bottom of the inside of said insert cup having a solid projectile body attached thereto and extending into the interior of said insert cup, whereby said insert cup may be inverted for use as a shuttlecock; and a lid for said container, said lid being shaped and sized to fit across the top of, around the rim of, and partially down the outside of said container, said lid also being shaped so as to be self-retentive around said rim area of said container so as to captivate said insert cup when said insert cup is nested in said container and said container is inverted, said lid having an opening therein for allowing a person to drink therethrough when said lid is in position on said container.

2. An insert cup for use with a liquid-carrying drinking container of at least a predetermined size for holding at least one temperature-altered solid body for changing the temperature of said liquid when said container is at least partially inverted for drinking and said beverage flows out of said container, said insert cup being sized to fit within said drinking container, said insert cup (a) being capable of holding said solid body, (b) having at least one opening for allowing said beverage to pass therethrough, (c) having means for holding itself in an upper portion of said drinking container above the surface of said beverage, (d) having a side wall with a plurality of folds therein such that the diameter of said cup will be self-adjusting to a predetermined size range of drinking containers, and (e) having a transitional wall extending down from a lower edge of said side wall, said transitional wall also tapering inwardly toward the center of said insert container and having slot-shaped openngs therein in alignment with the folds of said side wall, whereby when said insert container holds said solid body and said drinking container is inverted, the beverage in said drinking container will flow over and be changed in temperature by said solid body held by said insert cup.

3. The invention of claim 2 wherein said insert cup also has a bottom wall having a solid projectile body extending out therefrom in the interior of said cup, said solid body weighing at least as much as said insert cup and occupying a relatively small portion of the interior volume of said cup, whereby said insert cup may be inverted for use as a shuttlecock.

4. The invention of claim 3 wherein said solid projectile body has an elongated launching member thereto and extending therefrom, whereby said insert cup may also be used as a launchable projectile.

* * * * *